US006276046B1

(12) United States Patent
Chang

(10) Patent No.: US 6,276,046 B1
(45) Date of Patent: Aug. 21, 2001

(54) MOLDING METHOD FOR BICYCLE METAL FRAME

(75) Inventor: Ming Szu Chang, Changhua (TW)

(73) Assignee: Rudar Industry Co., Ltd., Changhua (TW)

( * ) Notice: Subject to any disclaimer, the term of this patent is extended or adjusted under 35 U.S.C. 154(b) by 0 days.

(21) Appl. No.: 09/418,126

(22) Filed: Oct. 14, 1999

(51) Int. Cl.[7] ..... B22D 11/128
(52) U.S. Cl. ..... 29/527.6; 164/63; 164/348
(58) Field of Search ..... 29/527.6; 164/63, 164/134, 348; 280/281.1

(56) References Cited

U.S. PATENT DOCUMENTS 4,145,068 * 3/1979 Toyomasu et al. ..... 280/281.1
4,660,345 * 4/1987 Browning ..... 164/63
5,980,800 * 11/1999 Tsai ..... 29/527.6
6,042,495 * 3/2000 Patterson et al. ..... 474/80

* cited by examiner

*Primary Examiner*—P. W. Echols
(74) *Attorney, Agent, or Firm*—Dougherty & Troxell

(57) ABSTRACT

A molding method for bicycle metal frame, including the steps of: pouring a fixed amount of molten metal into a reservoir with the relatively light oxide membrane floating on the upper surface of the clean and pure molten metal, the male and female molds being mated to define a bicycle frame mold cavity which is vacuumized through a vacuum path, then by way of high pressure filling, the clean and pure molten metal being filled into the mold cavity through a mold flow way, then the molten metal quickly passing through the mold flow way to flow and distribute over the vacuumized bicycle frame mold cavity and spilling back flow tank defined by the mated male and female molds by way of drawing out the mold core, then, immediately the molten metal being abruptly cooled through several cooling pipelines defined by the mated male and female molds to pattern the molten metal into a bicycle frame with polished surface without pore; demolding the male and female molds to take out the bicycle frame which is blown by wind and cooled into normal temperature; and by way of boring or reaming, modifying the perforations of the bicycle frame into right circular holes with necessary diameter so as to complete the integrally molded bicycle frame with complete metal phase and good structural strength.

1 Claim, 4 Drawing Sheets

Large, middle and small aluminum tubes with different diameters and lengths are selected.

↓

The large, middle and small aluminum tubes are respectively cut into several large diameter upper tubes, middle diameter lower tubes, small diameter front tubes, seat tube and large diameter five-way tube.

↓

The upper tube is punched and pressed into flat elliptic shape and two end faces thereof are cut into longitudinal concave end faces. One end face of the lower tube is cut into longitudinal concave end face, while the other end face thereof is cut into transverse concave end face.

↓

A flat upper tube, a five-way tube, a lower tube, a front tube and a seat tube and a five-way tube are provided. The longitudinal concave end faces of the upper tube are respectively welded to the front tube and the seat tube. Then the longitudinal concave end face of the lower tube and the front tube are welded on a lower side of the upper tube, while the transverse concave end face of the lower tube is welded at the center of the outer surface of the five-way tube.

Fig. 2

Prior Art

A fixed amount of molten metal is taken and poured into a reservoir in an automatic manner. The relatively light oxide membrane floats on the upper surface of the clean and pure molten metal. By way of high pressure filling, the clean and pure molten metal is filled into a mold flow way communicating with the passage of the reservoir. Then the molten metal quickly passes through the mold flow way to flow and distribute over the vacuumized bicycle frame mold cavity. Then, immediately the molten metal is abruptly cooled through several cooling pipelines defined by the mated male and female molds to pattern the molten metal into a bicycle frame.

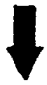

The male and female molds are separated and the bicycle frame with remaining temperature is taken out by an automatic mechanical device and conveyed by an automatic conveyor. Then the bicycle frame is air cooled to normal temperature.

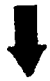

The perforations of the bicycle frame by way of boring or reaming are modified into right circular holes so as to complete the integrally molded bicycle frame.

Fig. 4

MOLDING METHOD FOR BICYCLE METAL FRAME

BACKGROUND OF THE INVENTION

The present invention relates to a molding method for a bicycle metal frame, in which the male and female molds are mated to define a bicycle frame mold cavity which is vacuumized. Then by way of high pressure filling, the clean and pure molten metal is filled into the mold cavity and a spilling back flow tank is defined by the mated male and female molds by way of drawing out the mold core to achieve an integrally molded bicycle frame having a polished surface with complete metal phase and good structural strength. The processing flow of the bicycle frame is simplified and the manufacturing procedure is speeded. Mass-production becomes possible so that the cost is lowered to promote competition.

FIGS. 1 and 2 show the conventional manufacturing flow chart of a bicycle metal frame. First, a large diameter aluminum tube 1, a middle diameter aluminum tube 2 and a small diameter aluminum tube 3 which have different diameters and a certain length are provided. Then the large diameter aluminum tube 1 is cut into several upper tubes 4 with a certain length and a five-way tube 5. The middle diameter aluminum tube 2 is cut into several lower tubes 6 with a certain length and the small diameter aluminum tube 3 is cut into several front tubes 7 with a certain length and seat tube 8. Then the upper tube 4 by way of punching and pressing is processed into a long and flat elliptic shape and two end faces thereof are cut into longitudinal concave end faces 4'. One end face of the lower tube 6 is cut into longitudinal concave end face 6', while the other end face thereof is cut into transverse concave end face 6". Finally, a flat upper tube 4, a five-way tube 5, a lower tube 6, a front tube 7 and a seat tube 8 are provided. One longitudinal concave end face 4' of the upper tube 4 is welded at an upper section of the front tube 7, while the other longitudinal concave end face 4' is welded at a certain position of the seat tube 8. Then the longitudinal concave end face 6' of the lower tube 6 is welded at a lower section of the front tube 7, while the transverse concave end face 6" is welded at the center of the outer surface of the five-way tube 5. Then the projecting welding sections are ground and planed to achieve a bicycle frame 9.

The above manufacturing method has some shortcomings as follows:

1. Different diameters of aluminum tubes with different diameters are selected and processed. This complicates the selection of material.
2. The selected different diameters of aluminum tubes are first according to specifications respectively cut into different lengths of upper tubes 4, five-way tube 5, lower tubes 6, front tube 7 and seat tube 8. The upper tube 4 by way of punching and pressing is further processed into long and flat elliptic shape and two end faces thereof are cut into longitudinal concave end faces 4'. One end face of the lower tube 6 is cut into longitudinal concave end face 6', while the other end face thereof is cut into transverse concave end face 6". This complicates the processing operation.
3. The upper tubes 4, five-way tube 5, lower tubes 6, front tube 7 and seat tube 8 are welded together by a specialist. However, the welding can achieve a limited connection strength so that the safety can hardly be ensured. Moreover, the projecting welding sections must be further processed and planed. This may detract from the appearance of the frame.

4. The manufacturing procedure of the bicycle frame is time-consuming and laborious. This increases the manufacturing cost and makes it impossible to mass-produce the bicycle frame and promote competition on the market.

SUMMARY OF THE INVENTION

It is therefore a primary object of the present invention to provide a molding method for bicycle metal frame, in which the male and female molds are mated to define a bicycle frame mold cavity which is vacuumized. Then by way of high pressure filling, the clean and pure molten metal is filled into the mold cavity. A spilling back flow tank is defined by the mated male and female molds by way of drawing out the mold core. Therefore, the amount of molten metal necessary for the bicycle frame gets completely into the mold cavity to achieve an integrally molded bicycle frame with complete metal phase and good structural strength.

It is a further object of the present invention to provide the above molding method in which the surface of the integrally molded bicycle frame has no pores which are produced in the common casting so that the surface of the bicycle frame is polished.

It is still a further object of the present invention to provide the above molding method in which the processing flow of the bicycle frame is simplified and the manufacturing procedure is speeded up. Mass-production then becomes possible so that the cost is lowered to promote competition.

The present invention can be best understood through the following description and accompanying drawings wherein:

BRIEF DESCRIPTION OF THE DRAWINGS

FIG. 2 is a block diagram of the flow chart of the conventional manufacturing procedure of bicycle metal frame;

FIG. 4 is a block diagram of the flow chart of the manufacturing procedure of bicycle metal frame of the present invention.

DETAILED DESCRIPTION OF THE PREFERRED EMBODIMENT

Figure 1:
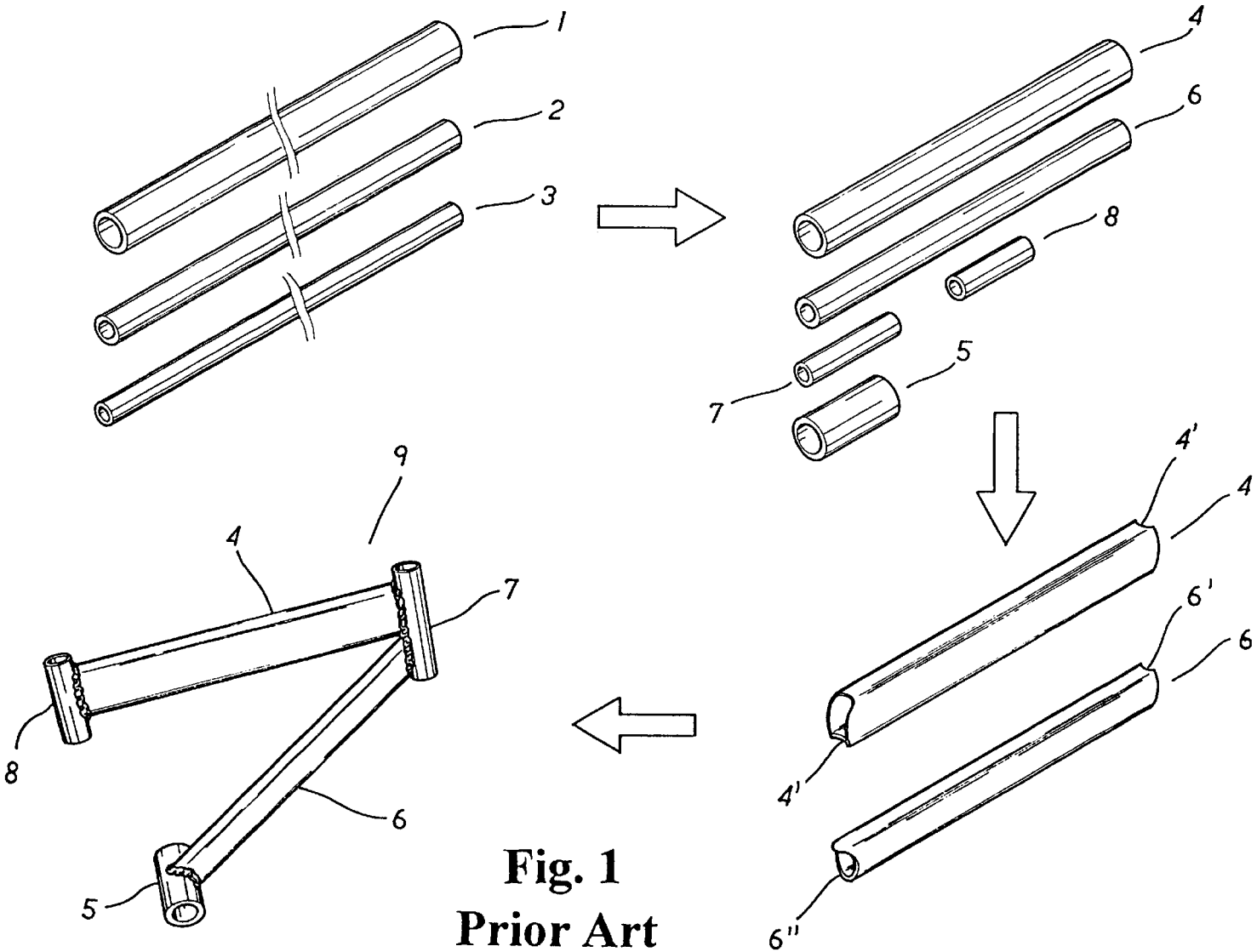
Fig. 1 Prior Art
FIG. 1 is a flow chart of the conventional manufacturing procedure of bicycle metal frame.
Figure 3:
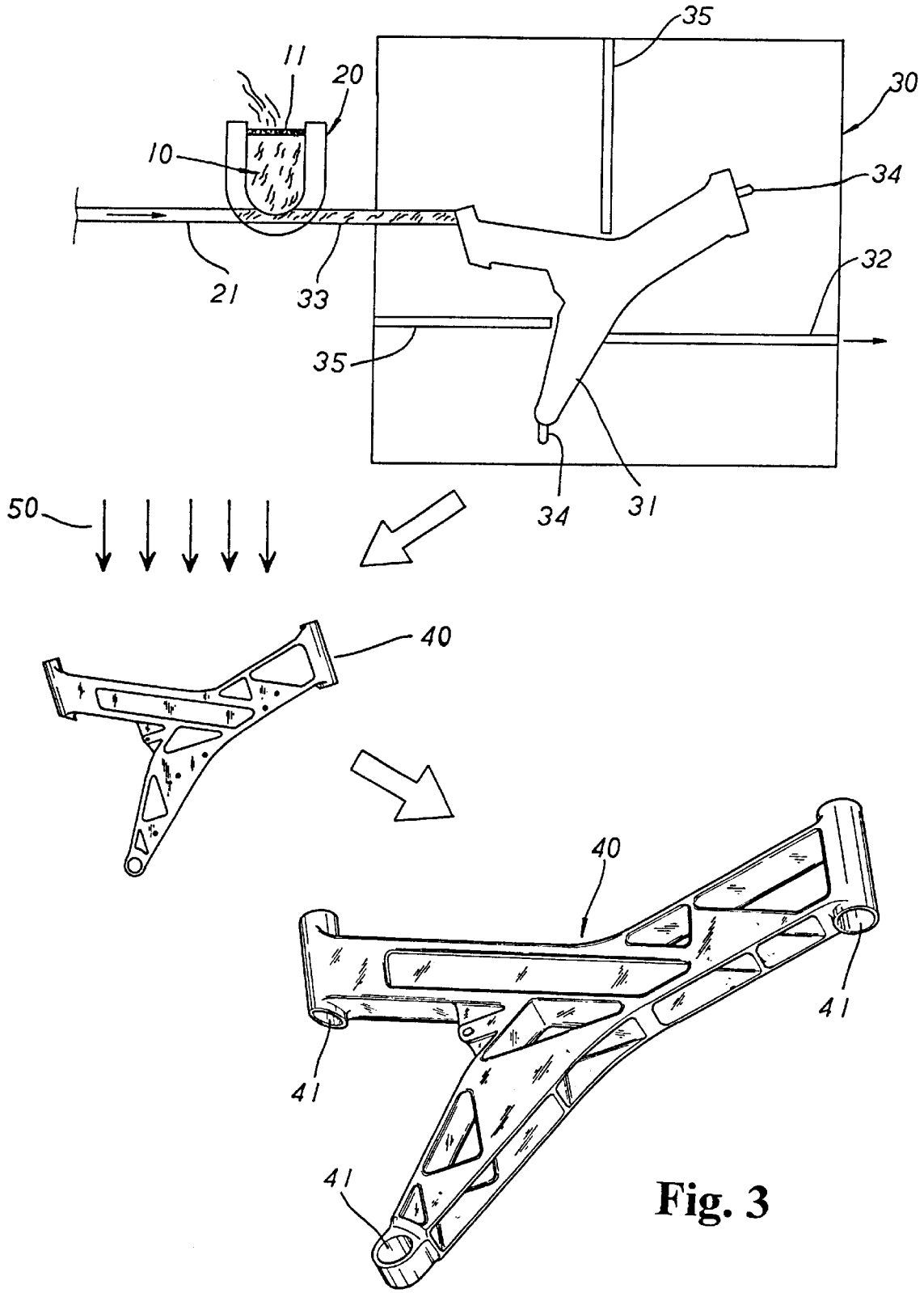
FIG. 3 is a flow chart of the manufacturing procedure of bicycle metal frame of the present invention.

Please refer to FIGS. 3 and 4 which show the manufacturing flow chart of the present invention. First, a fixed amount of molten metal 10 is taken and poured into a reservoir 20 in an automatic manner. The relatively light oxide membrane 11 floats on the upper surface of the clean and pure molten metal 10. The male and female molds 30 are mated to define a bicycle frame mold cavity 31 which is vacuumized through a vacuum path 32. Then by way of high pressure filling, the clean and pure molten metal 10 is filled into a mold flow way 33 communicating with the passage 21 of the reservoir 20. Then the molten metal 10 quickly passes through the mold flow way 33 to flow and distribute over the vacuumized bicycle frame mold cavity 31. Spilling back flow tanks 34 defined by the mated male and female molds 30 by way of drawing out the mold core. Then, immediately the molten metal is abruptly cooled through several cooling pipelines 35 defined by the mated male and female molds 30. At this time, the molten metal 10 is patterned into a bicycle frame 40 with a polished surface. Then the male and female molds 30 are separated and the bicycle frame 40 with remaining temperature is taken out by an automatic mechanical device and conveyed by an automatic conveyor. Then the bicycle frame 40 is blown by wind 50 and cooled into normal temperature. Finally, the perforations 41 of the bicycle frame 40 by way of boring or reaming are modified into right circular holes with necessary diameters so as to complete the integrally molded bicycle frame 40.

According to the above arrangement, the present invention has the following advantages:

1. The bicycle frame mold cavity 31 is vacuumized and the clean and pure molten metal 10 by way of high pressure filling is filled into the mold cavity 31 and the spilling back flow tank 34. Therefore, the amount of molten metal 10 necessary for the bicycle frame 40 can totally get in to achieve an integrally molded bicycle frame 40 with complete metal phase and good structural strength.
2. The surface of the integrally molded bicycle frame 40 has no pores which are produced in the common casting so that the surface is polished.
3. In the entire processing procedure, it is no longer necessary to go through those complicated operations including material selection, cutting, punching, pressing, welding, grinding and planing. Therefore, the manufacturing can be speeded and mass-production become possible so that the cost is lowered to promote competition.

The above embodiment is only used to illustrate the present invention, not intended to limit the scope thereof. Many modifications of the above embodiment can be made without departing from the spirit of the present invention.

What is claimed is:

1. A method of molding a one-piece bicycle frame comprising the steps of:

a) providing a mold having a mold cavity for a bicycle frame including a front tube portion, a seat tube portion and a sprocket tube portion, the mold including a vacuum path communicating with the mold cavity, at least one cooling pipeline and a molten metal flow way communicating with the mold cavity;

b) providing a reservoir with molten metal therein, the reservoir communicating with the molten metal flow way;

c) drawing a vacuum within the mold cavity through the vacuum path;

d) filling the mold cavity with molten metal under pressure through the molten metal flow way such that the molten metal fills the mold cavity, including the front tube portion, the seat tube portion and the sprocket tube portion;

e) cooling the molten metal in the mold cavity via the at least one cooling pipeline to solidify the molten metal such that the bicycle frame is integrally formed with a front tube, a seat tube and a sprocket tube;

f) removing the solidified metal bicycle frame from the mold;

g) air cooling the metal bicycle frame; and, h) machining interior surfaces of the front tube, the seat tube and the sprocket tube.

* * * * *